US006164108A

United States Patent [19]

Brown et al.

[11] Patent Number: 6,164,108

[45] Date of Patent: Dec. 26, 2000

[54] HYDRO COMPRESSION TUBE FORMING DIE APPARATUS AND METHOD FOR MAKING THE SAME

[75] Inventors: James H. Brown, Westland; Gary A. Webb, West Bloomfield, both of Mich.

[73] Assignee: Aquaform, Inc., Auburn Hills, Mich.

[21] Appl. No.: 09/357,608

[22] Filed: Jul. 20, 1999

Related U.S. Application Data

[60] Provisional application No. 60/093,612, Jul. 21, 1998.

[51] Int. Cl.[7] ..... B21D 26/02

[52] U.S. Cl. ..... 72/62; 72/61; 29/421.1

[58] Field of Search ..... 72/58, 61, 60, 72/62; 29/421.1

[56] References Cited

U.S. PATENT DOCUMENTS

| | | | |
|---|---|---|---|
| 2,811,941 | 11/1957 | Conrad . | |
| 4,289,007 | 9/1981 | Kraft | 72/58 |
| 4,414,834 | 11/1983 | Gratzer et al. . | |
| 5,097,689 | 3/1992 | Pietrobon | 72/58 |
| 5,415,021 | 5/1995 | Folmer | 72/58 |
| 5,815,901 | 10/1998 | Mason et al. | 72/62 |
| 5,979,201 | 11/1999 | Horton et al. | 72/58 |
| 6,009,734 | 1/2000 | Augustin et al. | 72/58 |
| 6,014,879 | 1/2000 | Jackel et al. | 72/61 |
| 6,041,633 | 3/2000 | Bieling | 72/61 |

FOREIGN PATENT DOCUMENTS 27 02 890 7/1978 Germany .

*Primary Examiner*—David Jones
*Attorney, Agent, or Firm*—Jenkens & Gilchrist

[57] ABSTRACT

An apparatus is provided for forming a tubular fitting from a blank tube having an interior. The apparatus includes a right die plate, a left die plate, a lower die plate and an upper die plate. The right die plate has a first cavity capable of receiving the blank tube. The left die plate has a second cavity aligned with the first cavity. The right die plate has a first guide post and the left die plate has a second guide post. The first cavity is joined to the second cavity to form a forming cavity. The lower die plate is capable of supporting the right die plate and the left die plate. The lower die plate includes a port capable of receiving a fluid line. The upper die plate is capable of moving between a first position and a second position. The upper die plate has guide holes for receiving the first and second guide posts and aligning the upper die plate with the right die plate and the left die plate. The apparatus further includes a fluid delivery means for communicating a fluid via the fluid line to the interior of the blank tube. A plunger is used to pressurize the fluid in the blank tube to expand the tube so that the shape of the tube conforms to the forming cavity.

16 Claims, 5 Drawing Sheets

HYDRO COMPRESSION TUBE FORMING DIE APPARATUS AND METHOD FOR MAKING THE SAME

This patent application claims the benefit of priority of U.S. provisional application Ser. No. 60/093,612, filed Jul. 21, 1998.

FIELD OF THE INVENTION

The present invention relates generally to the field of cold forming tubular materials and, more particularly, to an apparatus and method for hydroforming a tubular fitting from a blank tube.

BACKGROUND OF THE INVENTION

Industry requires standard blank tubes to be formed into one-piece tubular shapes. The general operations of bending, stretching, depressing and radially, expanding a tube blank, with or without a mandrel, are known. Some metals and alloys are formed into complex tubular shapes by a hydroforming process. The hydroforming process requires several steps to form the desired tubular shape. See, e.g., U.S. patent application Ser. No. 08/856,511, filed May 15, 1997, and assigned to the assignee of the present application, said application being incorporated herein by reference in its entirety. Generally, a tube or workpiece is placed between a pair of dies having cavities that define the desired resultant shape of the tube. The dies merge, and the ends of the workpiece are sealed with a pair of sealing units. The workpiece is filled with fluid which is then pressurized. Pressurizing the fluid within the workpiece results in expanding the workpiece to conform to the cavity shape. The fluid is drained from the workpiece and the sealing units are removed to release the workpiece. The main problem with this process is that hydroforming presses are extremely expensive. A single hydroforming press can cost approximately three million dollars.

Since mechanical or hydraulic presses are widely available and have been in service in many factories for years, attempts have been made to modify these presses to perform the above hydroforming operation. The problem with prior attempt to perform hydroforming operations on mechanical or hydraulic presses is that several additional pieces of equipment are required in order to make the hydroforming operation work. Such equipment may include, for example, external water units, external hydraulics and additional fittings, hoses and valves. This increases the cost and decreases the reliability of the hydroforming operation.

The present invention is directed toward eliminating some of the additional equipment required to perform a hydroforming operation.

SUMMARY OF THE INVENTION

In accordance with one aspect of the present invention, there is provided an apparatus for forming a tubular fitting from a blank tube having an interior. The apparatus includes a right die plate, a left die plate, a lower die plate and an upper die plate. The right die plate has a first cavity capable of receiving the blank tube. The left die plate has a second cavity aligned with the first cavity. The right die plate has a first guide post and the left die plate has a second guide post. The first cavity is joined to the second cavity to form a forming cavity. The lower die plate is capable of supporting the right die plate and the left die plate. The lower die plate includes a port capable of receiving a fluid line. The upper die plate is capable of moving between a first position and a second position. The upper die plate has guide holes for receiving the first and second guide posts and aligning the upper die plate with the right die plate and the left die plate. The apparatus further includes a fluid delivery means for communicating a fluid via the fluid line to the interior of the blank tube. A plunger is used to pressurize the fluid in the blank tube to expand the tube so that the shape of the tube conforms to the forming cavity.

BRIEF DESCRIPTION OF THE DRAWINGS

The foregoing and other advantages of the invention will become apparent upon reading the following detailed description and upon reference to the drawings in which.

Figure 1:
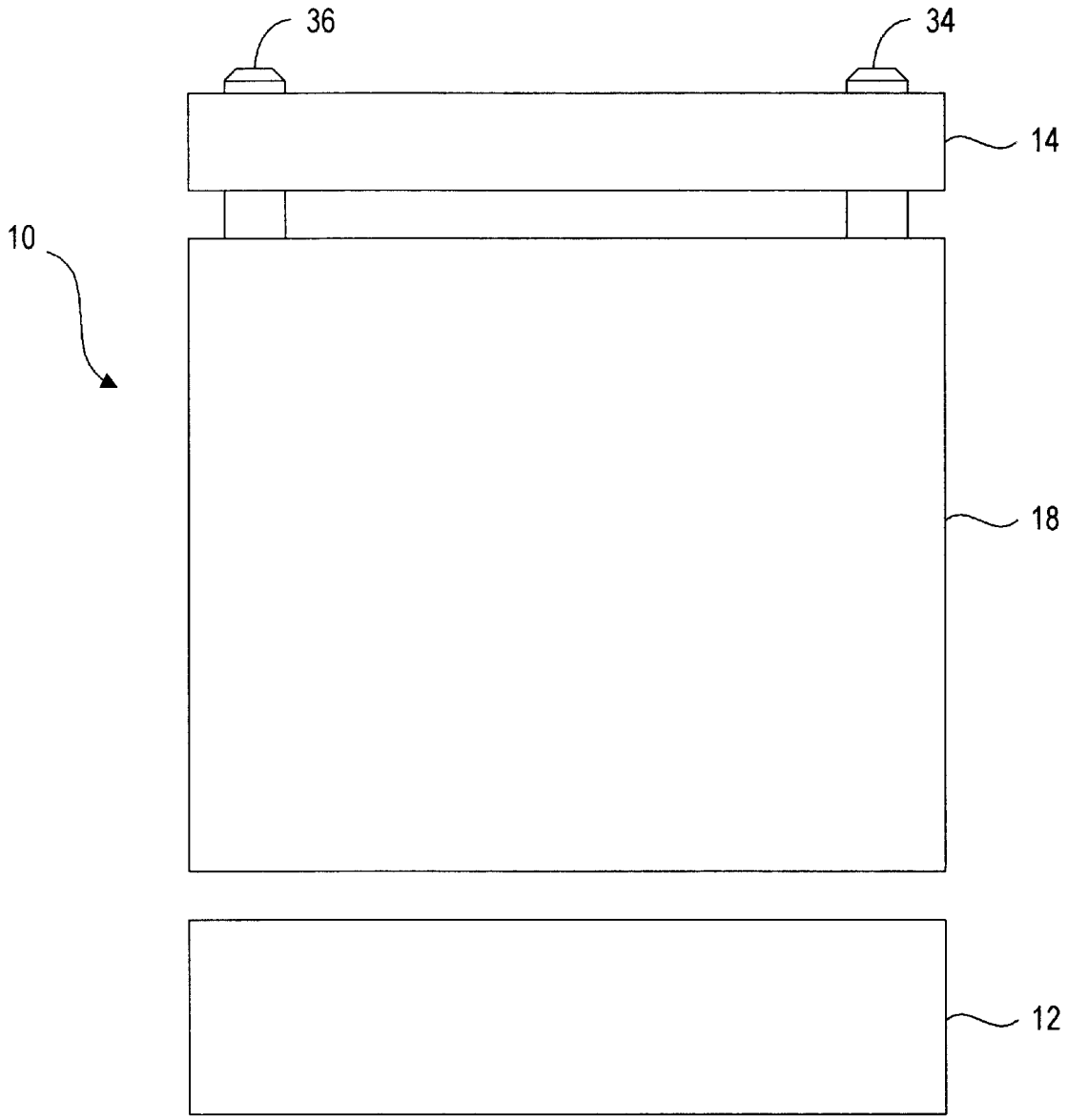
FIG. 1 is an exploded side view of a die according to one embodiment of the present invention.

While the invention is susceptive to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE INVENTION

In the present invention, a hydraulic press operates as a hydroforming apparatus. The hydroforming apparatus creates a tubular fitting from a blank tube. In one embodiment, the hydro compression tube forming die apparatus is used in a hydraulic press. The hydraulic press includes a ram press. The hydraulic press implements a hydroforming process that shapes the blank tube into a generally tubular shape. The hydroforming process requires the blank tube to be encased in a forming cavity between the right and left merged die plates. The blank tube is filled with fluid. A plunger begins in a retracted position. The plunger is lowered into the interior of the tube to the depth shown in order to pressurize the fluid and expand the blank tube into the recesses of the forming cavity. A tubular fitting is thus formed having a shape conforming to the forming cavity.

As illustrated in FIG. 1, the hydroforming apparatus used in the above process includes a die 10 having a right die plate 16 (shown in FIG. 3), a left die plate 18, a lower die plate 12 and an upper die plate 14. The upper die plate 14 is mounted to a ram press. The lower die plate 12 is mounted to a fixed die bed via bolt holes 50 (shown in FIG. 4).

Figure 5:
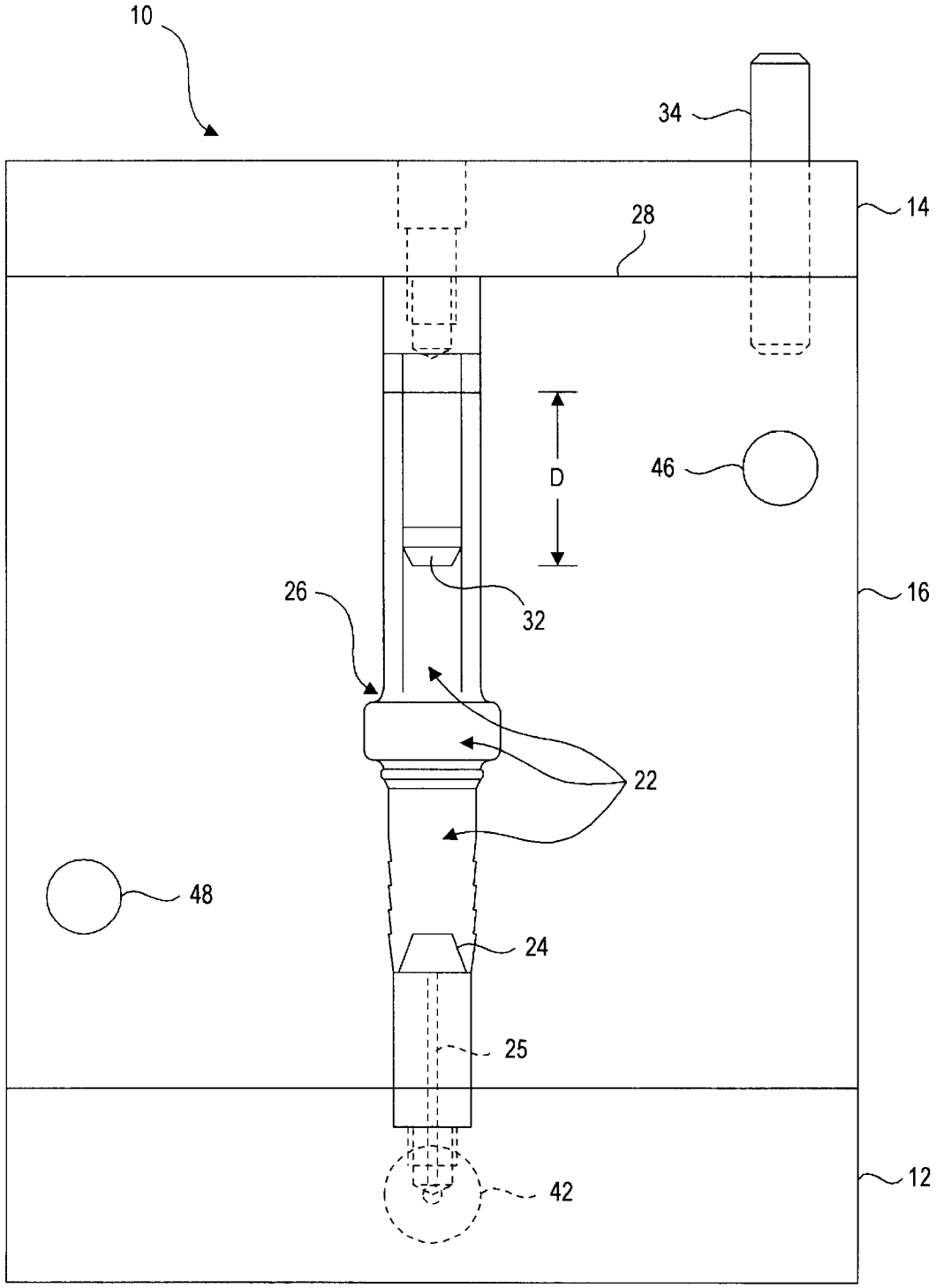
FIG. 5 is a cross-sectional view of the right die plate of FIG. 3 along line 5—5.

Referring to FIG. 5, a tubular fitting is formed by placing the blank tube, open end up, on a tube positioner 24 contained in a first cavity 22 in the right die plate 16. The left die plate 18 includes a second cavity. The first cavity 22 is aligned with the second cavity to form a forming cavity 26. The forming cavity 26 represents the desired cross-sectional shape of the formed tube.

Figure 2:
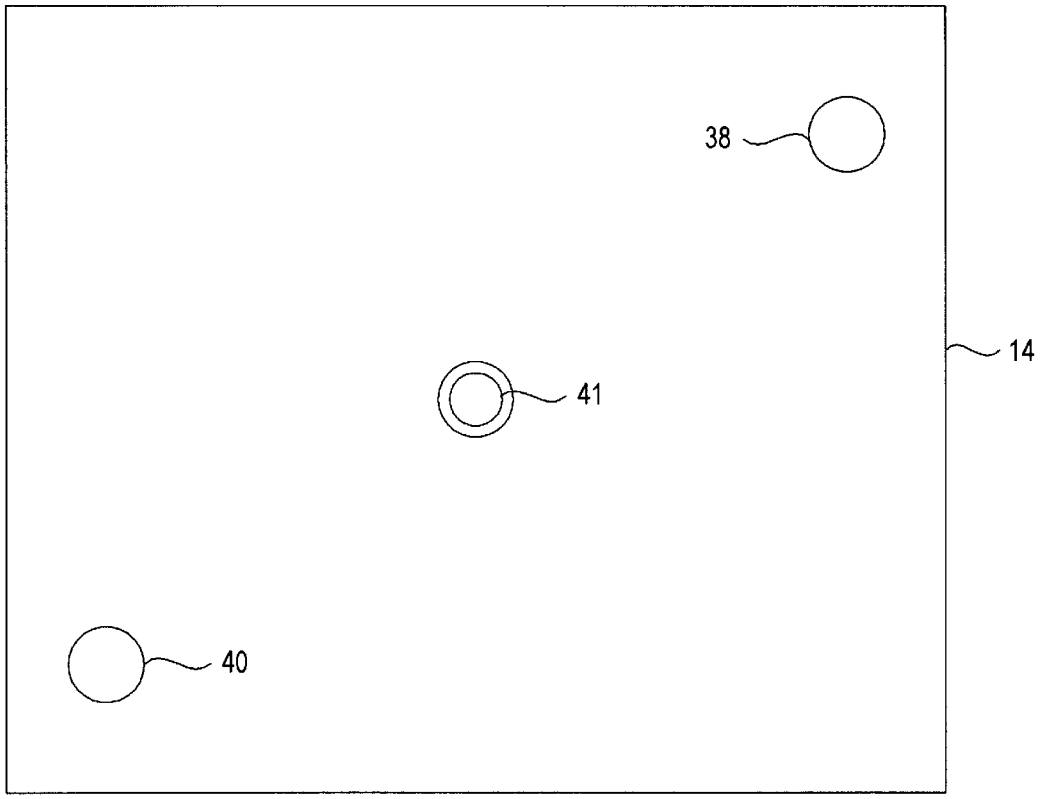
FIG. 2 is a top view of one embodiment of the upper die plate of the present invention.
Figure 3:
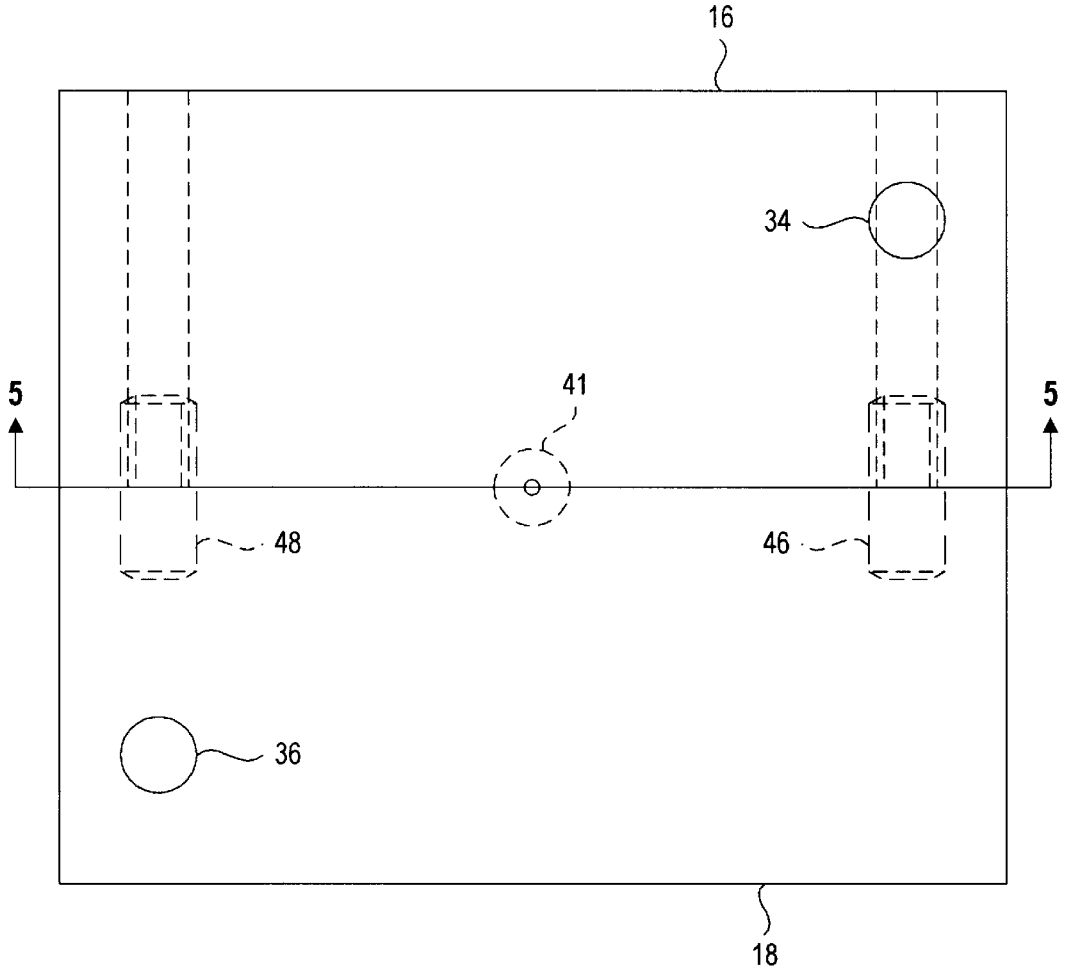
FIG. 3 is a top view of one embodiment of the right and left die plates of the present invention.

The lower die plate 12 supports the right and left die plates 16 and 18. When the hydroforming process begins, the upper die plate 14 is in a first position displaced away from the top 28 of the right and left die plates 16 and 18. Then, the ram press moves the upper die plate 14 from the first position to a second position adjacent the top 28, as illustrated in FIG. 5. The ram press moves the upper die plate 14 by a first moving means such as, for example, hydraulic cylinder assemblies and motor and screw combinations. As illustrated in FIG. 3, the right die plate 16 includes a first guide post 34 and the left die plate 18 includes a second guide post 36. As illustrated in FIG. 2, the upper die plate 14 has corresponding first and second guide holes 38 and 40 for receiving the first guide post 34 and the second guide post 36 and aligning the upper die plate 14 with the right and left die plates 16 and 18. The lowering of the upper die plate 14 presses the right and left die plates 16 and 18 into a sealed position.

Figure 4:
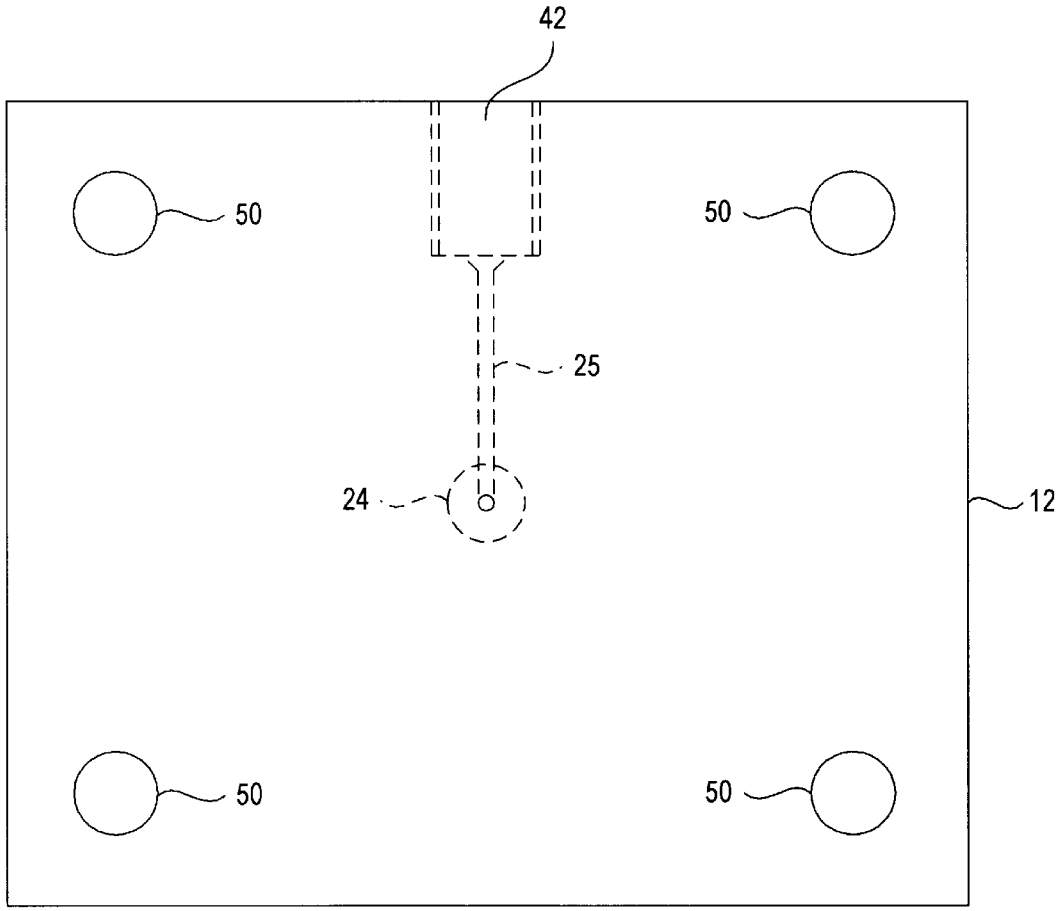
FIG. 4 is a top view of one embodiment of the lower die plate of the present invention.

Returning to FIG. 5, the right die plate 16 includes a tube positioner 24 having a conduit 25 therein capable of receiving and draining fluid. As illustrated in FIG. 4, the lower die plate 12 also includes a conduit 25 which is connected to a port 42 that is capable of receiving an adjoining member such as, for example, a fluid line, a pressure gauge, etc. A fluid delivery means such as, for example, a hydraulic pump, delivers fluid via the conduit 25 to the interior of the blank tube positioned in the forming cavity 26, illustrated in FIG. 5. Dowel pins 46, 48 are positioned partially within the right or first die plate 16 and partially within the left or second die plate 18, as shown in FIGS. 3 and 5. The conduit 25 is in fluid communication with the fluid line providing the fluid. A plunger 32 is used to pressurize the fluid in the blank tube. The pressurized fluid expands the tube so that it conforms to the forming cavity 26 thus forming the tubular fitting.

The pressure of the fluid in the tube is increased by lowering the plunge 32 through a plunger hole 41, as shown in FIGS. 2 and 3, and into the interior of the tube to the depth shown in FIG. 5. The ram press includes second moving means for lowering the plunger 32 into the fluid filled tube and thus increasing the pressure in the tube. Such moving means may include, for example, hydraulic cylinder assemblies and motor and screw combinations.

The resulting pressure in the tube is sufficiently high to expand the tube to fill the recesses of the forming cavity 26. This pressure is dependent on the material of the blank tube and the distance D the plunger is inserted into the tube. This pressure is greater than the yield point pressure that would expand the tube into the recesses of the forming cavity and less than the yield point pressure of the die plates. In normal operation, the pressure is greater than 10,000 pounds per square inch. For example, the pressure can be as high as 100,000 pounds per square inch, as long as the die plates are not separated. The typical pressure range is between 50,000 and 100,000 pounds per square inch.

By increasing the pressure of the fluid in the tube, the tube expands into the recesses of the forming cavity 26. After the tube has been expanded, the pressure on the fluid is lowered by retracting the plunger 32 and draining the fluid from the formed tube via the conduit 25 in the tube positioner 24. The upper die plate 14 is then raised to allow the formed tube to be removed from the right and left die plates 16 and 18. The formed tube may be removed with the aid of lifters.

While particular embodiments and applications of the present invention have been illustrated and described, it is to be understood that the invention is not limited to the precise construction and compositions disclosed herein and that various modifications, changes, and variations will be apparent from the foregoing descriptions without departing from the spirit and scope of the invention as defined in the appended claims.

What is claimed is:

1. An apparatus for forming a tubular fitting from a blank tube having an interior, said apparatus comprising:

a first die plate having a first cavity capable of receiving said blank tube, said first die plate having a first guide post;

a second die plate having a second cavity aligned with said first cavity, said second die plate having a second guide post, said first cavity and said second cavity configured to be joined to form a forming cavity;

a lower die plate capable of supporting said first die plate and said second die plate, said lower die plate having a port capable of receiving a fluid line;

an upper die plate capable of moving between a first position and a second position, said upper die plate having first and second guide holes for receiving said first and second guide posts and aligning said upper die plate with said first die plate and said second die plate;

a fluid delivery means for communicating a fluid via said fluid line to said interior of said blank tube; and a plunger positioned in said interior of said blank tube for pressurizing said fluid in said blank tube and thereby expanding said tube so that it conforms to said forming cavity.

2. The apparatus of claim 1, wherein said fluid delivery means includes a hydraulic pump.

3. The apparatus of claim 1 further comprising at least one dowel pin, said dowel pin partially located within said first die plate and partially located within said second die plate.

4. The apparatus of claim 1 wherein said upper die plate is mounted to a ram press.

5. The apparatus of claim 4 wherein said ram press moves said upper die plate by a hydraulic cylinder assembly.

6. The apparatus of claim 4 wherein said ram press moves said upper die plate by a motor and screw combination.

7. The apparatus of claim 1 wherein said lower die plate is mounted to a fixed die bed.

8. The apparatus of claim 1 wherein said forming cavity has the desired cross-sectional shape of the formed tube.

9. A method of forming a tubular fitting from a blank tube having interior, said method comprising the steps of:

providing a first die plate having a first cavity, said first die plate having a first guide post;

positioning said blank tube in said first cavity;

providing a second die plate having a second cavity, said second die plate having a second guide post;

aligning said second cavity with said first cavity to produce a forming cavity;

supporting said first die plate and said second die plate with a lower die plate, said lower die plate having a conduit;

providing an upper die plate capable of moving between a first position and a second position, said upper die plate having first and second guide holes;

aligning said first and second guide posts with said first and said second guide holes, respectively;

moving said upper die plate from said first position to said second position to allow said first and second guide holes to receive said first and second guide posts, respectively;

providing a fluid to said interior of said blank tube via said conduit; and moving a plunger into said interior of said blank tube to pressurize said fluid to expand said forming cavity.

10. The method of claim 9 wherein said conduit is connected to a port capable of receiving an adjoining member.

11. The method of claim 10 wherein said adjoining member is a fluid line.

12. The method of claim 10 wherein said adjoining member is a pressure gauge.

13. The method of claim 9 wherein said fluid is pressurized from about 10,000 pounds per square inch to about 100,000 pounds per square inch.

14. The method of claim 13 wherein said fluid is pressurized from about 50,000 pounds per square inch to about 100,000 pounds per square inch.

15. The method of claim 9 further comprising, after the moving a plunger step, the step of retracting said plunger to drain said fluid and reduce said pressure of said fluid.

16. The method of claim 15 further comprising, after the retracting said plunger step, the step of raising said upper die plate.

* * * * *

UNITED STATES PATENT AND TRADEMARK OFFICE

CERTIFICATE OF CORRECTION

PATENT NO. : 6,164,108
DATED : December 26, 2000
INVENTOR(S) : James H. Brown et al.

It is certified that error appears in the above-identified patent and that said Letters Patent is hereby corrected as shown below:

Column 5, claim 9,
Line 2, please insert "said tube so that it conforms to" after -- to expand --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*